United States Patent [19]

Berman

[11] Patent Number: 4,513,670

[45] Date of Patent: Apr. 30, 1985

[54] TELLER MACHINE ENCLOSURE

[76] Inventor: James Berman, 160 E. 93rd St., New York, N.Y. 10028

[21] Appl. No.: 313,209

[22] Filed: Oct. 20, 1981

[51] Int. Cl.[3] ..... G07G 5/00

[52] U.S. Cl. ..... 109/24.1; 52/67

[58] Field of Search ..... 109/2, 9, 10, 17, 24.1, 109/45, 48, 49, 58, 66, 53, 73, 78, 79; 52/67, 29, 64, 69, 71; 232/43.1, 43.4

[56] References Cited

U.S. PATENT DOCUMENTS

| | | | |
|---|---|---|---|
| Re. 22,431 | 2/1944 | Sloan, Jr. | 52/67 |
| 1,919,986 | 7/1933 | Powers | 52/69 |
| 3,815,949 | 6/1974 | Ulert | 52/67 |
| 4,106,732 | 8/1978 | Whiting | 52/67 |
| 4,133,571 | 1/1979 | Fillios | 52/67 |
| 4,179,723 | 12/1979 | Spencer | 109/24.1 |
| 4,192,544 | 3/1980 | Patterson | 52/67 |

*Primary Examiner*—John J. Wilson

*Attorney, Agent, or Firm*—McAulay, Fields, Fisher, Goldstein and Nissen

[57] ABSTRACT

The secure enclosure for an automatic teller has a rear wall which moves between a forward position defining a smaller enclosure and a rearward position defining a larger enclosure. The rear wall has side and top panels which extend forward from the rear wall and which nest into the main walls of the enclosure. In the extended state, these panels provide the wall continuity that defines an extended yet continually secure enclosure. A locked door in one of the side panels provides personnel access when the enclosure is in its extended state. Yet this locked door is nested in the main walls and thus unaccessible when the enclosure is in its telescoped or nested state.

6 Claims, 5 Drawing Figures

TELLER MACHINE ENCLOSURE

BACKGROUND OF THE INVENTION

This invention relates in general to a secure enclosure for an automatic teller machine, which is commonly referred to as an ATM in this art.

Considerations of space and security very much affect and limit the usefulness of automatic teller machines in banking facilities.

Most banks have been designed without a particular thought to the inclusion of automatic teller machines. The addition of these machines requires the allocation of floor space for the machine. To provide a secure space around the machine a substantial amount of floor space has to be allocated to the automatic teller machine. This also often involves expensive on-site-construction.

The allocation of space, particularly to achieve adequate security, as well as the cost of on-site construction very much limits the extension of automatic teller machines to non-bank locations such as in supermarkets and to off-site locations such as drive up teller situations.

Indeed, the drive up ATM environment frequently requires that the enclosure for the automatic teller machine be relatively small preferably in the range of a five foot by five foot area.

Where the enclosure for the ATM is restricted because of location, floor space limitations, and/or cost, a major problem occurs when access has to be had to the automatic teller machine for the replacement of funds or for the making of minor repairs such as when cards or paper envelopes jam the machine.

Accordingly it is a major purpose of this invention to provide an enclosure, for an automatic teller machine, which requires the allocation of a minimum of floor space yet provides secure access to the machine for cash replacement and repair work.

It is a related purpose of this invention to provide an enclosure for an automatic teller machine which has enhanced security without requiring on-site construction.

It is a further and related purpose of this invention to achieve these objects in an embodiment which is adaptable to use in a wide variety of installation situations.

Because of the growing requirement for these machines in a wide variety of installation situations, it is a further purpose of this invention to provide a secure, compact automatic teller machine enclosure at a cost which will justify widespread multiple site installation.

To facillitate installation in a wide range of sites, it is important that the enclosure avoid critical dimensions and tolerances so that adjustments can be made to floors with slight slopes and other site variations.

BRIEF DESCRIPTION

In brief, one embodiment of this invention involves a telescoping enclosure. The automatic teller machine (ATM) has a secure permanent front panel which forms the front panel of the enclosure, on which the machine is mounted and through which access is had to the teller machine. Opposed side walls and an upper wall are securely connected to the front wall and extend back from the front wall to define the enclosure within which the automatic teller machine (ATM) is contained. This enclosure is securely mounted to the floor and, if necessary, a floor wall may be provided in order to reinforce the floor and deter access to the enclosure through the floor. The rear wall of the enclosure has forwardly extending side and upper panels which extend into respective channels within the side and upper walls of the enclosure. The rear wall is mounted on rollers so that it can be moved between a forward position and an extended position.

This rear wall, when in the forward position, abuts against the rear edges of the side walls and top wall. The rear wall can be rolled back to provide nearly twice the space within the enclosure and when rolled back to its extended position, the extended enclosure is securely defined by the side and upper walls together with the side and upper panels which extend from the rear wall forward into the channels of the side and upper wall.

A locked door in one of the side panels provides access to the extended enclosure. This permits an operator to have access to the automatic teller machine with enough space to effect changing of the money, making an immediate reconcilation of accounts and performing minor repairs without being either viewed by others or having to be on guard against would be thieves. When the authorized personnel is through and exits from the extended enclosure, the rear wall is rolled forward thereby telescoping the panel into the walls and enclosing the door in one of the side panels to be completely inaccessible within one of the wall channels.

BRIEF DESCRIPTION OF THE DRAWINGS

FIG. 1 shows the enclosure in its closed or telescoped state.

FIG. 2 illustrates how the extended state of the enclosure provides room for an entry door to open, room for a working counter to be swung up and room for a back panel of the automatic teller device to be swung open to permit access.

FIGS. 1 and 2 are in approximately the same scale and FIG. 3 is shown at about two-thirds the linear scale of FIGS. 1 and 2.

DESCRIPTION OF THE PREFERRED EMBODIMENTS

Figure 1:
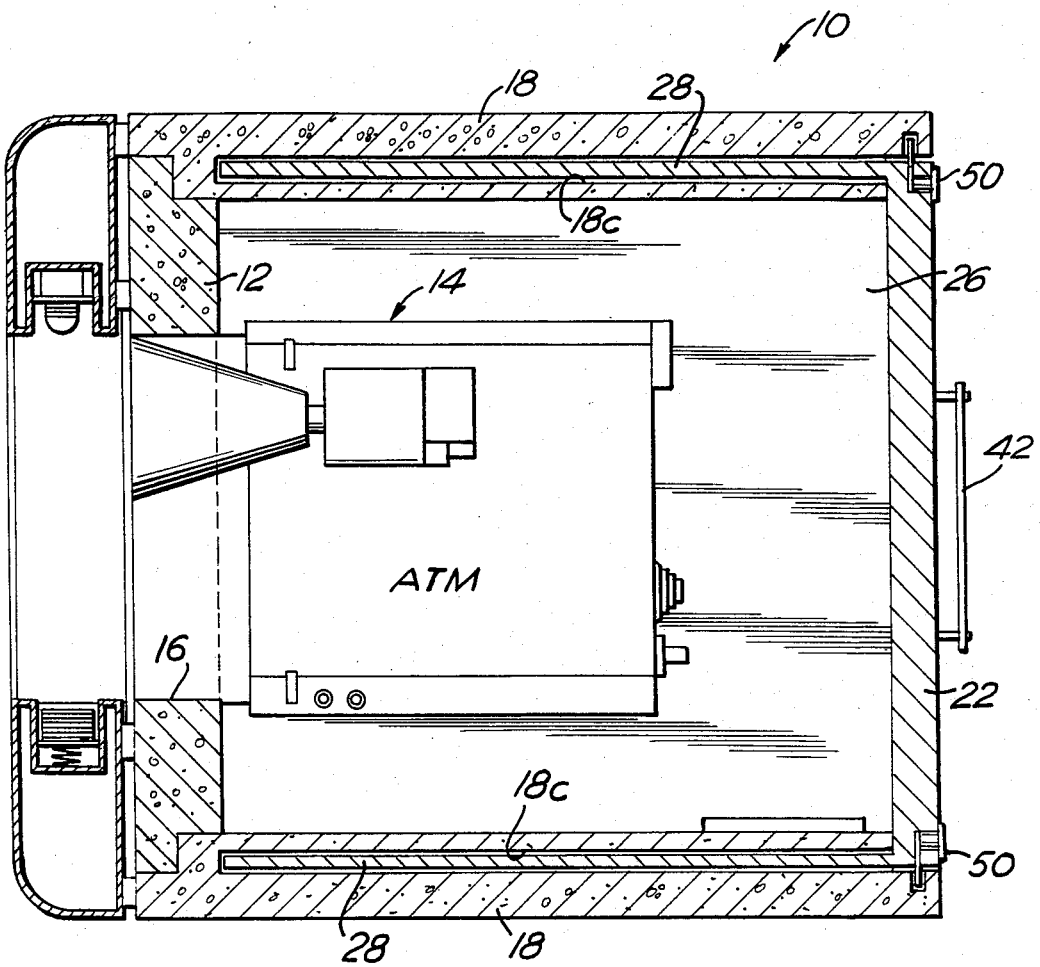
FIG. 1 is a plan view in partial section of an embodiment of this invention showing the side walls in cross section and the interior in relief.

As shown in the FIGS., all of which represent the same embodiment, the enclosure 10 of this invention has a front wall 12 to which an automatic teller 14 is mounted. A large central opening 16 in the front wall 12 provides access to the automatic teller 14. First and second side walls 18 and a top wall 20 are securely fastened to the front wall 12 and extend back from the front wall 12. These walls 18, 20 together with a rear wall 22 and a floor panel 24 define an enclosed space 26 within which the automatic teller 14 is contained. First and second side panels 28 and top panel 30 are securely attached to and extend forward from the rear wall 22.

The enclosure 10 has a telescoped state as shown in FIG. 1 in which the rear wall 22 is in a forward position. When in this telescoped or forward state, the side panels 28 are received within channels 18*c* within the side walls 18. A continuous four foot long roller 32 is attached to the bottom edge of the rear wall 22 to facilitate rolling the rear wall 22 and the attached panels 28, 30 between the forward state shown in FIG. 1 and the extended state shown in FIGS. 2 and 3. When in the extended state, as shown in FIG. 2, the side panels 28 move to the outboard position as shown but the forward ends of these side panels 28 still extend into the channels 18*c* in order to continue to define a secure enclosed area or zone within which the automatic teller 14 is located.

Figure 4:
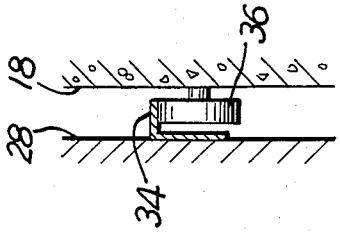
FIG. 4 is a cross-sectional view along plane 4—4 of FIG. 3 illustrating the manner in which the movable side panels which are attached to the movable rear wall, are carried on runners which ride on rollers mounted to the main enclosure wall.
Figure 5:
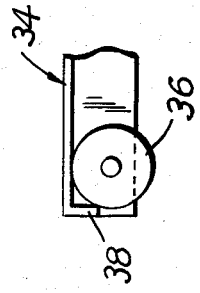
FIG. 5 is a view, parallel to the plane of FIG. 3, of a section of the end of one of the runners which carry the side panels showing the stop mechanism for limiting the rearward travel of the rear enclosure wall and attached panels.

As shown in FIGS. 4 and 5, brackets 34 attached to each of the side panels 28 serve as the support runners which ride on rollers 36 that are attached to the side walls 18. A stop 38 attached to each bracket 34 limits the travel of the side panels 28 and thus of the rear wall 22 and top panel 30 so that in the extended state shown in FIGS. 2 and 3 a secure enclosure is maintained.

Figure 2:
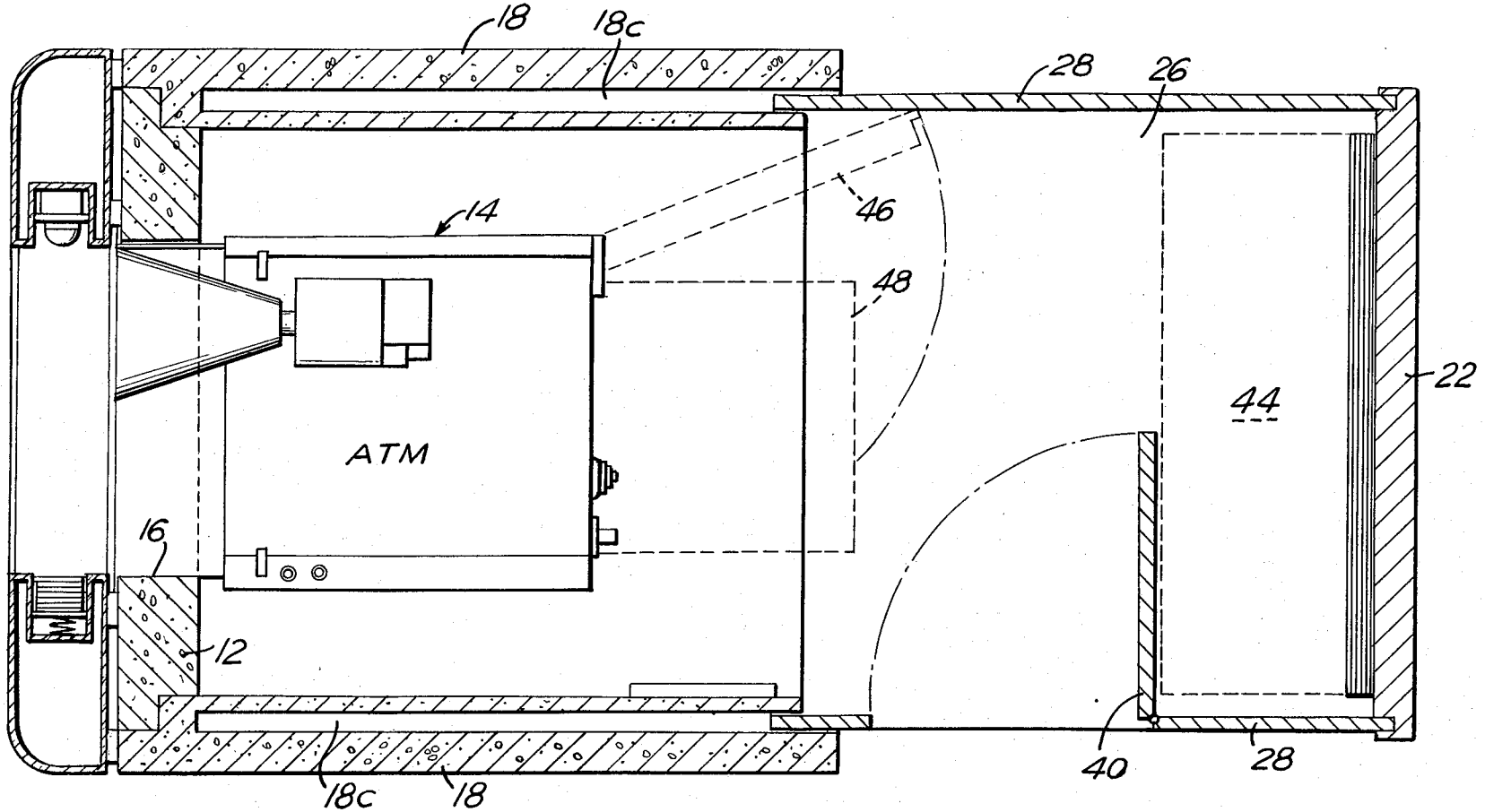
FIG. 2 is a view similar to that of FIG. 1 except that the enclosure is in its extended or opened state.

A door 40 in one of the side panels 28 may be opened as shown in FIG. 2 when the enclosure 10 is in its extended state. However, when the enclosure is in its telescoped state, the door 40 is contained within the channel 18*c* of the wall 18 and thus cannot be used to provide access to the enclosed space 26. When access is needed to the automatic teller 14 to replace forms or money or to provide maintenance, the wall 22 is unlocked and the wall 22 is pulled back by a handle 42 thereby extending the enclosed space that is shown in FIG. 1 to that shown in FIG. 2. The stops 38 determine the limit of how much the space 26 can be extended. The door 40 can then be opened and personnel enter the space 26. The door 40 is then closed and preferably locked. Inside the space 26, service personnel can swing up a counter 44 which is pivoted to the rear wall 22. Sufficient space is available so that a rear panel 46 of the automatic teller 14 can be swung out to permit access to the interior of the automatic teller 14 and, as illustrated in FIG. 2, the interior mechanism 48 of the automatic teller 14 can be pulled out for servicing.

Figure 3:
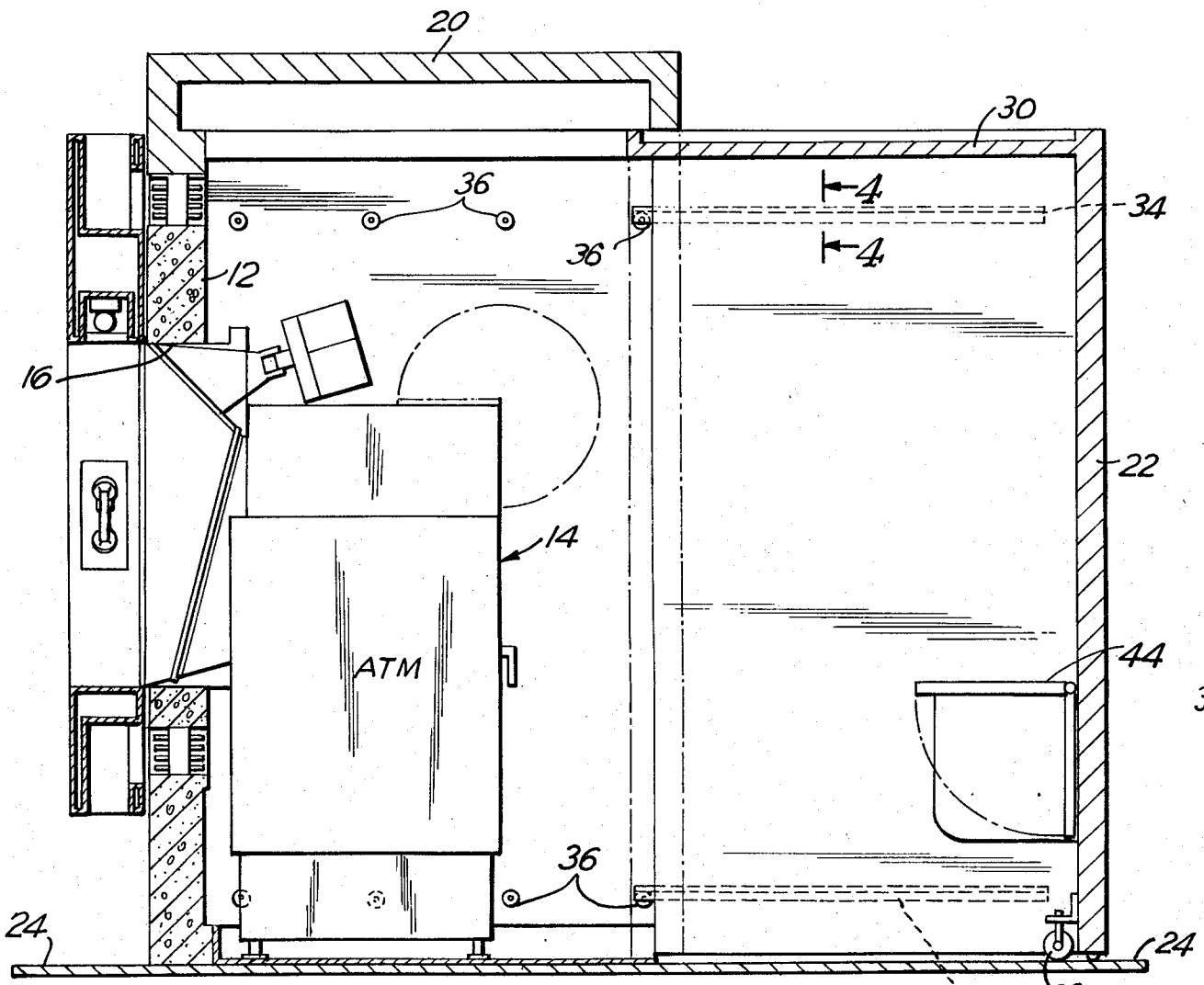
FIG. 3 is a side view in partial cross section of the enclosure in its extended or opened state illustrating the side walls in cross section and the automatic teller in release. For purposes of comparison, it should be understood that both

The floor panel 24 that is shown in FIG. 3 can be a steel panel which is bolted to the floor or, where the floor is sufficiently secure, as when it is poured concrete, the panel 24 may not be needed and the enclosure device 10 of this invention can be mounted directly on to the floor.

When in the forward state, the rear wall 22 is locked to the side wall 18 by cylinder locks 50.

As may be seen from a review of FIG. 2, when the enclosure 10 is in the telescoped state the position of the rear wall 22 is such that the rear panel 46 of the automatic teller 14 cannot be fully swung open and the interior mechanism 48 cannot be fully pulled out.

What I claim is:

1. A teller machine enclosure comprising walls, a base, a roof and a movable wall component movable between a closed position and an extended position and which movable wall component is provided with walls, a ceiling, and an entry door so that when the movable wall component is in its extended position, there is established a service enclosure contiguous with the area enclosed by said teller machine enclosure, and wherein an automatic teller machine, having customer operated controls, is mounted in said teller machine enclosure so that the customer operated controls are accessible from outside the teller machine enclosure, and servicing of the machine is performed from the service enclosure formed when the movable wall component is in its extended position.

2. A securely enclosed teller machine comprising:

a teller maching having an openable access panel, and a secure enclosure around said teller machine, said enclosure including:

a first side wall extending at least from a floor at a first side of the teller machine, up, over and down to the floor on the second side of the teller machine, an end wall, said end wall having a retracted position secured to said side wall and a protracted position disconnected from said side wall and protracted to a position spaced from said side wall, said first side wall and said end wall in said retracted position defining a first enclosure space enclosing the teller machine, said first enclosure space being insufficient to permit full opening of the access panel of the teller machine, a second side wall connected to said end wall, said second side wall, when said end wall is in said protracted position, extending over the space between said first side wall and said end wall to provide a second enclosure space adjacent to said first enclosure space and in communication with said first enclosure space, said first and second enclosure spaces in combination providing sufficient space for fully opening said access panel of said teller machine mounted in said first enclosure space.

3. The apparatus of claim 2 wherein:

said first side wall includes a right side wall, a left side wall, and an upper wall connecting said side walls, both said right and left side walls are of double wall construction to provide full wall interior channels extending along both said right side wall and said left side wall, said second side wall having left and right side panels and an upper panel connecting said side panels, said side panels nesting in respective one's of said interior channels when said end wall is in said retracted position, said side panels extending forward partially into respective one's of said interior channels when said end wall is in said protracted position.

4. The apparatus of claims 2 or 3 further comprising:

a stop mechanism having first and second stop members connected respectively to said first and second side walls to stop the protraction of said end wall at a predetermined protraction thereof.

5. The apparatus of claims 2 or 3 further comprising:

a roller mechanism connected to the base of said end wall to support and facilitate movement of said end wall between said retracted and said protracted positions.

6. The apparatus of claim 2 further comprising:

a door in said second side wall, said door being contained within said first side wall and inaccessable when said end wall is in said retracted position.

* * * * *